United States Patent [19]

Nelson

[11] 4,015,647

[45] Apr. 5, 1977

[54] AUTOMATIC NOZZLE ASSEMBLY

[75] Inventor: Lowell F. Nelson, Muskegon, Mich.

[73] Assignee: Enterprise Brass Works, Muskegan, Mich.

[22] Filed: Nov. 10, 1975

[21] Appl. No.: 630,302

[52] U.S. Cl. ..... 141/206

[51] Int. Cl.[2] ..... B65B 57/14

[58] Field of Search ..... 141/1, 198, 206–229, 141/392

[56] References Cited

UNITED STATES PATENTS 3,817,285 6/1974 Wilder et al. ..... 141/206 X

*Primary Examiner*—Richard E. Aegerter
*Assistant Examiner*—Frederick R. Schmidt
*Attorney, Agent, or Firm*—McGlynn and Milton

[57] ABSTRACT

An automatic nozzle assembly for the dispensing of gasoline and similar liquids and of simple, efficient and low cost construction. A stem extends into a housing and is actuated by a handle. The stem extends through a check valve which closes a downstream opening in a valve seat secured in the housing. A poppet valve is disposed about the valve stem and closes the upstream side of the opening in the valve seat to prevent fluid flow therethrough. A yoke is disposed about the upper end of the poppet valve and balls are disposed in openings in the poppet valve and are forced into engagement with the top of the stem whereby the poppet valve moves upwardly with the stem and whereby the yoke may be moved to allow the balls out of engagement with the stem whereby the poppet valve may close independently of movement of the stem. The movement of the yoke is controlled by the movement of a diaphragm which, in turn, is in communication with an annular groove in the valve seat which is, in turn, in communication with the opening in the valve seat through passages whereby a venturi is formed between the check valve and the opening in the valve seat to create a vacuum. Normally, the vacuum is in fluid communication, through a vacuum tube connected to the valve seat, with the end of a nozzle tube connected to the housing such that, when liquid covers the end of the vacuum tube, the vacuum is applied to the diaphragm to cause movement thereof to automatically allow the poppet valve to close.

11 Claims, 4 Drawing Figures

AUTOMATIC NOZZLE ASSEMBLY

The subject invention relates to an automatic nozzle assembly for dispensing gasoline and similar fluids with an automatic shut-off to prevent overflow of the container being filled.

The automatic nozzle assembly of the instant invention is of the type which includes a poppet valve in the nozzle housing which is moved between open and closed positions and is normally opened by a stem moved by a handle disposed exteriorly of the housing. Normally a mechanical means interconnects the stem and the poppet valve whereby the poppet valve is opened upon movement of the stem by the handle but allows the poppet valve to close without movement of the stem in response to a vacuum being applied to a diaphragm. There are numerous such automatic nozzle assemblies known to the prior art. Examples of such are shown in the following U.S. Pat. Nos: 2,363,123 granted to G. E. Franck on Nov. 21, 1944; 2,929,418 granted to J. F. Ryan, Jr. on Mar. 22, 1960; 3,224,472 granted to K. Ehlers on Dec. 21, 1965 and 3,451,444 granted to R. Q. Murray on June 24, 1969.

There has been a constant effort in the industry to provide an automatic nozzle assembly characterized by simplicity of operation and incorporating a minimum number of parts, yet which is reliable and may be economically produced. The automatic nozzle assembly of the subject invention meets these criteria.

Other advantages of the present invention will be readily appreciated as the same becomes better understood by reference to the following detailed description when considered in connection with the accompanying drawings wherein.

Figure 1:
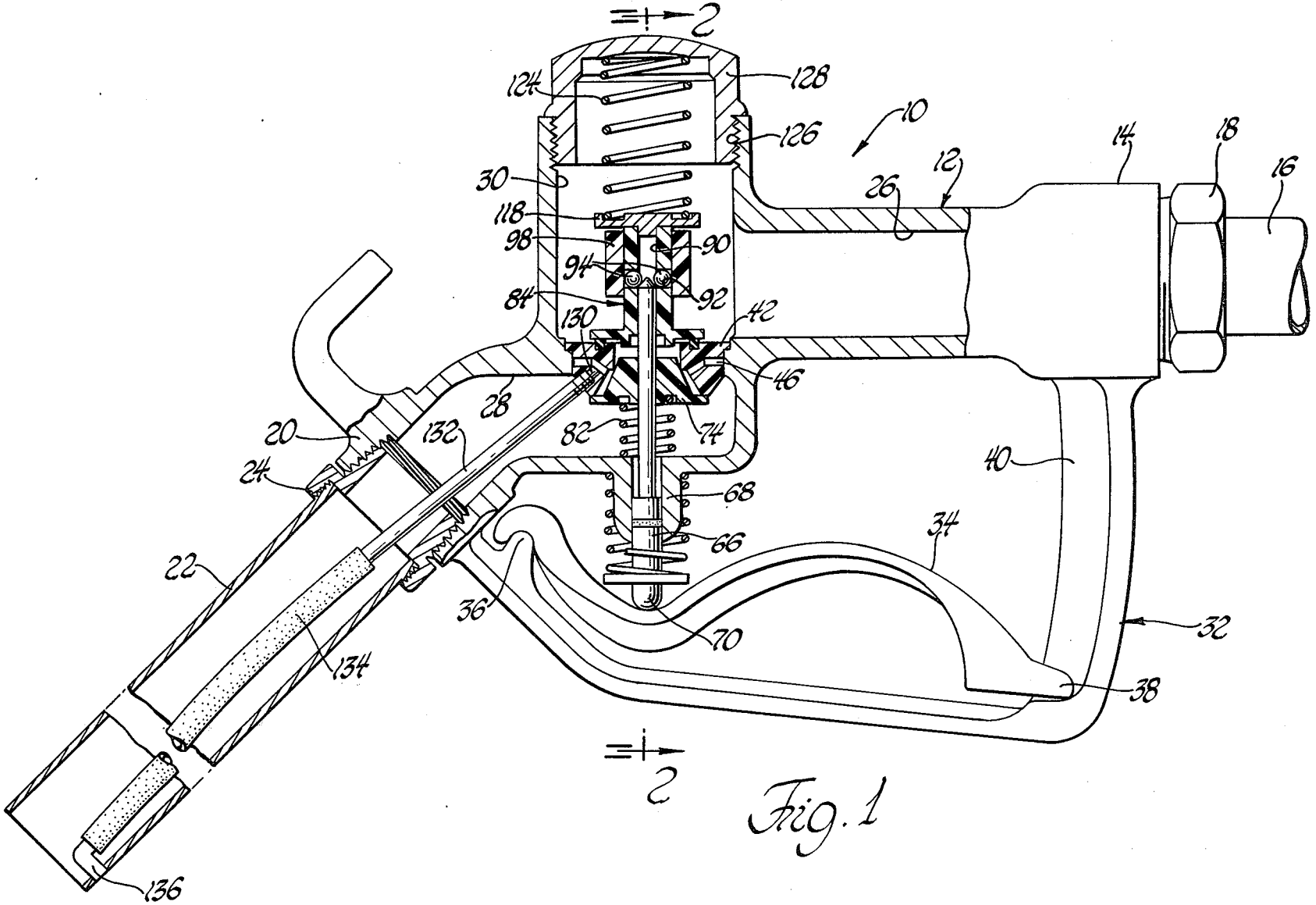
FIG. 1 is a side elevational view partially broken away and in cross section of a preferred embodiment of the subject invention.

Referring to the drawings, an automatic nozzle assembly constructed in accordance with the instant invention is generally shown at 10.

The nozzle assembly 10 includes a housing means or housing defined by an integral casting, or the like, and generally indicated at 12. The housing 12 includes an inlet 14 to which a hose 16 may be connected by a threaded fitting 18. The housing 12 also includes an outlet 20 to which is connected a nozzle tube 22 through threaded fitting 24. A fluid passageway extends between the inlet 14 and the outlet 20 and includes an upper portion 26 and a lower portion 28 which are generally parallel to one another. The upper portion 26 of the fluid passage empties into a valve cavity 30, which is generally circular and transverse to the upper passage 26. Integrally connected to the housing is a handle guide portion generally indicated at 32. A manually actuated handle 34 is pivotally supported at 36 on the guide portion 32. The rear end of the handle 34 is bifurcated at 38 to engage either side of a flange 40.

An annular valve seat 42 is disposed in the fluid passage between the upper and lower portions 26 and 28 thereof. The annular valve seat 42 is in sealing engagement with the housing and is preferably made of a plastic material. The valve seat 42 has an opening 44 extending therethrough, the opening 44 extending in a direction transverse to the fluid passage portions 26 and 28 and being axially aligned with the valve cavity 30. The valve seat 42 has an annular groove 46 extending about the periphery thereof. The valve seat 42 also includes four valve passages 48 extending through the valve seat between the annular groove 46 and the valve opening 44. The housing 12 also includes a diaphragm cavity 50. The diaphragm cavity 50 is defined by an integral part of the housing casting and a stamped metal cover 52, which is bolted by the bolts 54 to the housing. A diaphragm 56 divides the diaphragm cavity into a first or atmospheric chamber 58 and a second vacuum chamber 60. The cap 52 has an opening 62 therein whereby atmospheric pressure is subjected to the atmospheric chamber 58.

The housing includes a passage 64 establishing communication with the second or vacuum chamber 60 and the annular groove 46 in the valve seat 42.

A valve stem 66 extends through a stem receiving portion 68 of the housing 12 to a rounded end 70 which is engaged by the handle 34 exteriorly of the housing. The valve stem 66 is in sealing engagement with the housing by way of a seal 72 and extends upwardly through the opening 44 in the valve seat 42.

An annular conical check valve 74 is slidably disposed on the stem 66 for engaging the valve seat 42 in the opening 44 thereof on the downstream side of the opening 44. The valve seat 42 has as annular lip 76 which is engaged by the conical portion of the check valve 74 and the check valve 74 has an annular flange 78 which engages the lower face of the valve seat 42. The lower face of the check valve 74 includes an annular recess 80 and a first coil spring 82 is disposed in the recess 80 at one end and abuts the housing at the other end about the stem 66 for urging the check valve 74 into the opening 44. The spring 82, however, allows the check valve 74 to move out of the opening 44 to an open position in response to fluid flow therethrough. The check valve 74 coacts with the valve seat 42 to create a venturi in the opening 44 in response to fluid flow therethrough to create a suction or vacuum to which the valve passages 48 are subjected and are responsive.

A spring stop 69 is secured to the lower end of the stem 66 and a coil spring 71 reacts between the stop 69 and the housing to urge the stem 66 against the handle 34.

Figure 2:
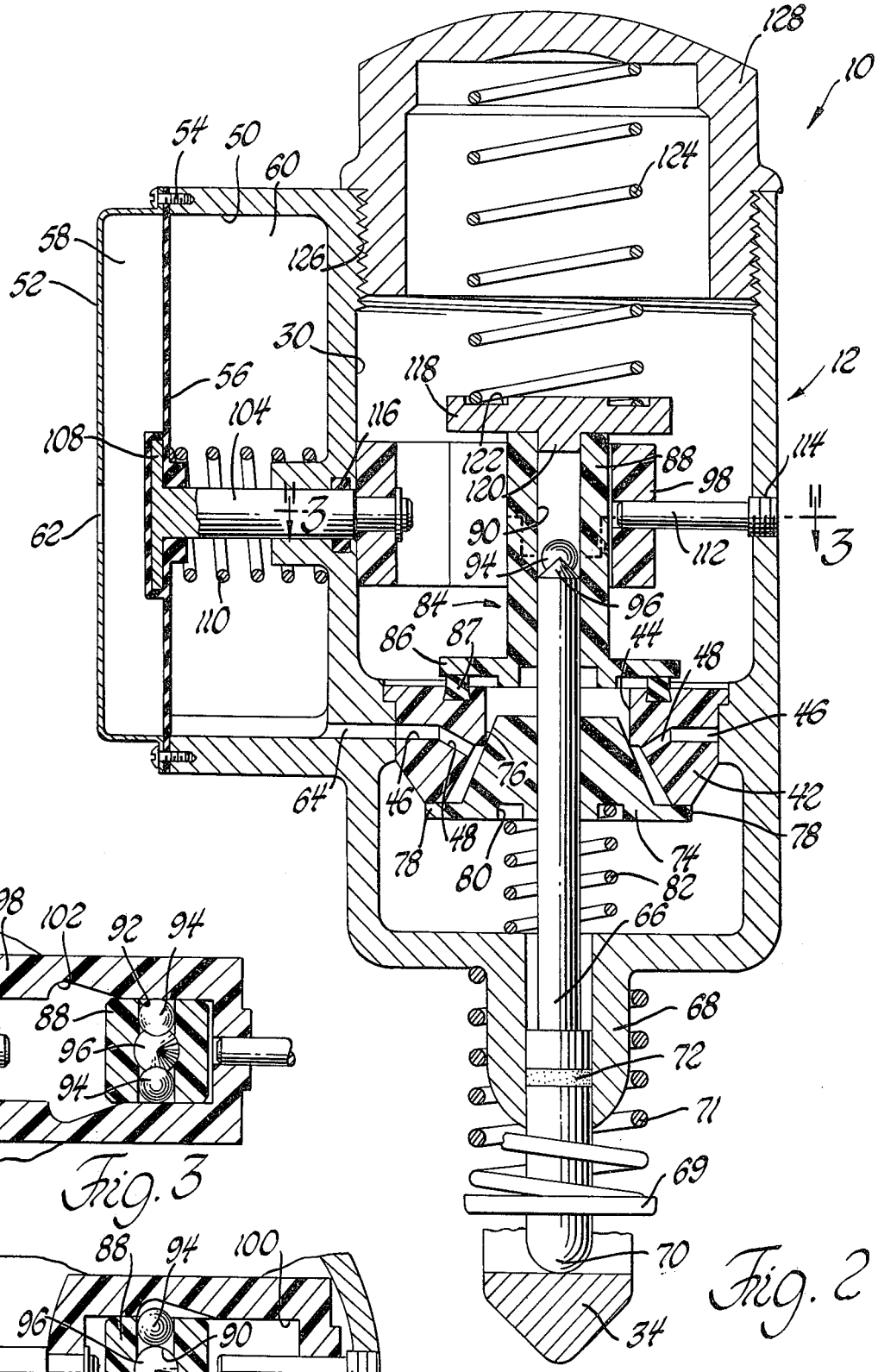
FIG. 2 is an enlarged cross-sectional view taken substantially along line 2—2 of FIG. 1.

The assembly also includes a poppet valve generally indicated at 84 for engaging the valve seat 42 in a closed position, as illustrated in FIG. 2, on the upstream side of the opening 44 for closing the opening 44 to prevent fluid flow therethrough. The poppet valve 84 includes an annular platelike valve portion 86 for opening and closing the opening 44 in the valve seat 42. A seal 87 is disposed between the platelike valve portion 86 and the valve seat 42, the seal 87 being pertained in an annular recess in the upper face of the valve seat 42. The poppet valve 84 also includes a guide portion 88 extending upwardly from the plate-like valve portion 86. The poppet valve 84 has a stem bore 90 extending upwardly from the bottom thereof through the guide portion 88 to an open upper end. The upper end of the stem 66 is slidably disposed in the stem bore 90. The guide portion 88 has a cross bore 92 intersecting the stem bore 90.

Figure 3:
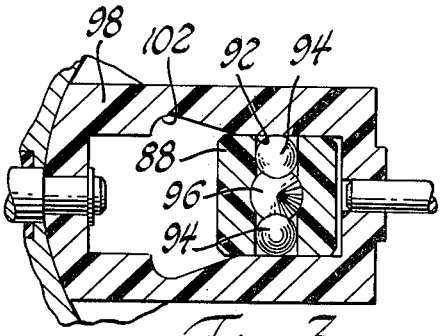
FIG. 3 is a fragmentary cross-sectional view taken substantially along line 3—3 of FIG. 2.

The assembly also includes control means interconnecting the valve stem 66, the poppet valve 84 and the diaphragm 56 for causing the poppet valve 84 to open in response to movement of the valve stem 66 but to close independently of movement of the valve stem in response to movement of the diaphragm 56. More specifically, the control means includes a pair of balls 94 disposed in the cross bore 92 on either side of the upper end of the stem 66. The stem 66 has a conical upper end 96 disposed in the stem bore 90 for engaging the balls 94, as best illustrated in FIGS. 1, 2 and 3.

Figure 4:
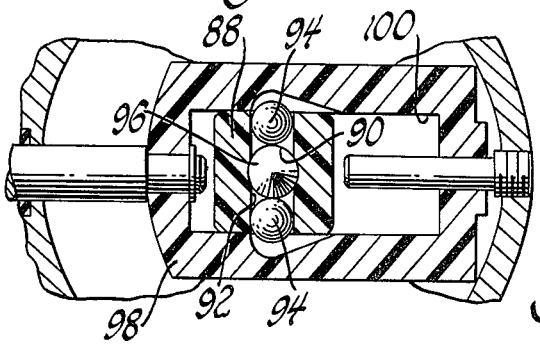
FIG. 4 is a view similar to FIG. 3 but showing the mechanism in a moved position.

The control means further includes a yoke 98 having a generally rectangular opening so as to be disposed about the guide portion 88 of the poppet valve 84, the guide portion 88 of the poppet valve being rectangular or square in cross-sectional configuration. The yoke 98 has a waist portion 100 which engages the balls 94 when in the locked position shown in FIG. 3 to maintain a portion of the balls 94 extending into the stem bore 90 to engage the upper end 96 of the stem whereby the poppet valve 84 moves upwardly upon upward movement of the stem 66. The yoke 98 has an enlarged portion 102 adjacent the waist portion 100 for allowing the balls 94 to move laterally in the cross board 92 and out of the stem bore 90 when the yoke 98 is in the unlocked position whereby the poppet valve 84 may move downwardly to the closed position independently of movement of the stem 66, as is illustrated in FIG. 4.

The control means further includes a rod 104 which interconnects the diaphragm 56 and the yoke 98. The rod 104 extends through one end of the yoke 98 and has a snap ring secured thereto for interconnecting the rod 104 and the yoke 98. The other end of the rod 104 has a head 108 about which a portion of the diaphragm 56 is molded into sealing engagement therewith. A helical coiled spring 110 reacts between the housing and the head portion 108 of the rod 104 to return the diaphragm to the neutral position shown in FIG. 2. A guide pin 112 threadedly engages the housing at 114 and extends into the valve cavity 30 and into a bore in the yoke 98 for supporting and guiding movement of the yoke 98. The guide pin 112 is axially aligned with the rod 104. The diaphragm cavity 50 is disposed laterally of the valve cavity 30 and the axis of the stem 66 and the poppet valve 84 whereby the rod 104 extends perpendicularly to the axis of movement of the poppet valve 84. The rod 104 is in sealing engagement with the housing by way of a seal 116.

A base 118 is disposed atop of the guide portion 88 of the poppet valve 84 and includes a projection 120 extending into the stem bore 90 on its lower face thereof and a spring retaining means or groove 122 on its upper face for receiving a second coiled spring 124. The housing means includes a threaded access opening 126 which is axially aligned with the stem 66 and a cap 128 threadedly engages the housing means in the access opening 126 and the second spring 124 reacts between the cap 128 and the base 118.

The valve seat 74 also includes a tube receiving passage 130, as shown in FIG. 1, into which a tube 132 is threadedly engaged so as to be in fluid communication with the annular passage 46. The tube 132 is preferably of metal and is connected to a flexible plastic tube 134 which is, in turn, connected to an elbow 136 disposed at a position adjacent the open end of the nozzle tube 22.

OPERATION

The automatic nozzle assembly 10 is in the off position as shown in FIGS. 1 and 2. When it is desired to use the automatic nozzle assembly 10, the nozzle tube 22 is inserted into a container and the handle 34 is manually pivotted upwardly to move the stem 66 upwardly. As the stem 66 moves upwardly its upper conical end 96 engages the balls 94 as the balls 94 are prevented from moving laterally outwardly in the bore 92 because of the waist portion 100 of the yoke 98. Thus, the poppet valve 84 moves upwardly with the stem 66 to open the opening 44. Fluid under pressure then pushes the check valve 74 open and a venturi is created between the check valve 74 and the valve seat 42 to cause a vacuum to be subjected to the valve passages 48. Such a vacuum is communicated to the annular groove 46 and to the tube receiving passage 30 and, hence, to the tubes 132 and 134 and the elbow 136. Hence, air is drawn through the elbow 136 and into the opening 44 in the valve seat 42 as fluid flows therethrough. Such occurs until the container becomes full and liquid covers the elbow 136 cutting off air flow therethrough. At this point the vacuum is subjected through the passage 64 to the vacuum chamber 60 of the diaphragm cavity 50. Under this vacuum the diaphragm 56 moves to the right and because of the connection between the diaphragm 56 and the yoke 98 through the rod 104 the yoke 98 moves to the right from the position shown in FIG. 3 to the position shown in FIG. 4 where the balls 94 may move radially outwardly into the enlarged portion 102 of the yoke. When the balls 94 are in the enlarged portion 102 of the yoke 98 they are no longer interfering with the stem in the stem bore 90 and, therefore, the spring 124 moves the poppet valve 84 downwardly to the closed position stopping fluid flow. When the nozzle assembly is removed from the container the handle 34 is returned to the initial position shown in FIG. 1 and the vacuum is removed from the vacuum chamber 60 thereby returning the diaphragm 56 and the yoke 98 to the initial position shown in FIG. 2. Of course, when the poppet valve 84 closes and there is no fluid flow through the opening 44, the check valve 74 returns to the position shown. The check valve 74 moves out of the opening 44 a distance which is responsive to the pressure of fluid flow being subjected thereto.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practifed otherwise than as specifically described.

The embodiments of the invention in which an exclusive property or privilege is claimed are defined as follows:

1. An automatic nozzle assembly comprising: housing means having an inlet and an outlet and a fluid passage extending therebetween, an annular valve seat disposed in said fluid passage in sealing engagement with said housing and having a valve opening therethrough, said valve seat having an annular groove about the periphery thereof, at least one valve passage extending through said valve seat between said groove and said valve opening, said housing means defining a diaphragm cavity, a diaphragm dividing said diaphragm cavity into first and second chambers, said housing means having a passage therein communicating said second chamber of said diaphragm cavity with said annular groove in said valve seat, a valve stem extending through said housing means for engagement by a handle exteriorly of said housing means, said valve stem being in sealing engagement with said housing means and extending through said opening in said valve seat, a check valve slidably disposed on said stem for engaging said valve seat in the opening thereof on the downstream side of said opening, first spring means reacting between said housing means and said check valve for urging said check valve into said opening and for allowing said check valve to move out of said opening in response to fluid flow to create a venturi with said opening in said valve seat to which said valve passage is responsive, a poppet valve member for engaging said valve seat in a closed position on the upstream side of said opening for closing said opening to prevent fluid flow therethrough, second spring means reacting between said housing means and said poppet valve for urging said poppet valve to said closed position, said poppet valve being disposed upon said valve stem, control means interconnecting said valve stem and said poppet valve and said diaphragm for causing said poppet valve to open in response to movement of said valve stem and to close independently of movement of said valve stem in response to movement of said diaphragm.

2. An assembly as set forth in claim 1 wherein said valve seat includes a tube receiving passage for connection to tube means and in fluid communication with said annular groove.

3. An assembly as set forth in claim 2 including a nozzle connected at one end to said outlet of said housing means and extending to an open end, tube means connected to said tube receiving passage and extending within said nozzle to a position adjacent said open end thereof.

4. An assembly as set forth in claim 3 wherein said poppet valve includes a plate-like valve portion for opening and closing said opening in said valve seat, seal means disposed between said plate-like valve portion and said valve seat, said poppet valve includes a guide portion extending upwardly from said plate-like valve portion, said poppet valve having a stem bore extending upwardly through said guide portion, said stem being slidably disposed in said stem bore, said guide portion having a cross bore intersecting said stem bore, said control means includes a pair of balls disposed in said cross bore on either side of said stem, said stem having a conical upper end disposed in said stem bore for engaging said balls.

5. An assembly as set forth in claim 4 wherein said control means further includes a yoke disposed about said guide portion of said poppet valve and a rod interconnecting said yoke and said diaphragm for shifting said yoke transversely to said guide portion between locked and unlocked positions, said yoke having a waist portion engaging said balls in said locked position to maintain a portion of said balls in said stem bore to engage said upper end of said stem whereby said poppet valve moves upwardly with said stem, said yoke having an enlarged portion adjacent said waist portion for allowing said balls to move out of said stem bore when in said unlocked position whereby said poppet valve may move to said closed position independently of said stem.

6. An assembly as set forth in claim 5 wherein said control means further includes a rod interconnecting said diaphragm and said yoke, said diaphragm cavity being disposed laterally of said poppet valve and said rod extends generally perpendicular to the axis of movement of said poppet valve, said rod being in sealing engagement with said housing means.

7. An assembly as set forth in claim 6 including a guide pin extending from said housing means and slidably disposed in an aperture in said yoke on the opposite side thereof from said rod for guiding and supporting said yoke.

8. An assembly as set forth in claim 7 wherein said guide portion of said poppet valve is rectangular in cross-sectional configuration.

9. An assembly as set forth in claim 8 including a base disposed atop said guide portion of said poppet valve with a projection extending into said stem bore, said base having a spring retaining means, said second spring being disposed in said spring retaining means.

10. An assembly as set forth in claim 9 including spring means urging said stem out of said housing means.

11. An assembly as set forth in claim 10 wherein said housing means includes an access opening axially aligned with said stem, a cap threadedly engaging said housing means in said access opening, said second spring reacting between said cap and said base.

* * * * *